US007467613B2

(12) United States Patent
Taylor, Sr.

(10) Patent No.: US 7,467,613 B2
(45) Date of Patent: Dec. 23, 2008

(54) INTERNAL COMBUSTION ENGINE WITH CYLINDER AND PISTON HAVING A DUAL-COMBUSTION STROKE

(76) Inventor: David M. Taylor, Sr., 1320 #6 G Street, Sparks, NE (US) 89431

( * ) Notice: Subject to any disclaimer, the term of this patent is extended or adjusted under 35 U.S.C. 154(b) by 0 days.

(21) Appl. No.: 11/626,250

(22) Filed: Jan. 23, 2007

(65) Prior Publication Data

US 2008/0173286 A1 Jul. 24, 2008

(51) Int. Cl.
*F02F 1/00* (2006.01)

(52) U.S. Cl. ..... 123/193.2; 123/61 R

(58) Field of Classification Search ... 123/193.1–193.6, 123/90.27, 55.1–55.7, 61 R, 52.2, 52.5
See application file for complete search history.

(56) References Cited

U.S. PATENT DOCUMENTS 2,070,769 A 2/1937 Wurtele
4,414,927 A 11/1983 Simon
4,913,100 A 4/1990 Eickmann
5,676,097 A 10/1997 Montresor
5,967,103 A 10/1999 Kuperman
6,467,440 B1 * 10/2002 Kozulin et al. ..... 123/61 R
D494,191 S 8/2004 Aketa et al.
6,904,883 B2 * 6/2005 Snyder et al. ..... 123/90.31

* cited by examiner

*Primary Examiner*—Stephen K Cronin
*Assistant Examiner*—Hyder Ali
(74) *Attorney, Agent, or Firm*—Advantia Law Group; Michael W. Starkweather; Jason P. Webb

(57) ABSTRACT

Internal combustion engines having V-and L-configurations. There are first and second piston systems, each including: an engine block; a cylinder through the engine block; a piston within the cylinder, the piston with piston rings, including a cavity therein the underside; a stump member disposed within the cylinder and sized to be received by the cavity, and having a bore through the center to a direction of travel of the piston; a connecting rod, connected between the piston, and a crankshaft; a first and second combustion chambers defined between the piston, the cylinder, and the upper engine head, and between the piston, the cylinder, the stump member, and the cylinder floor respectively; an inlet port, an outlet port, and a spark plug/fuel injector port; each disposed through the engine block orthogonal to a direction of travel of the piston.

8 Claims, 12 Drawing Sheets

INTERNAL COMBUSTION ENGINE WITH CYLINDER AND PISTON HAVING A DUAL-COMBUSTION STROKE

BACKGROUND OF THE INVENTION

1. Field of the Invention

The present invention relates to internal combustion engines, specifically to internal combustion engines with a cylinder and piston having a dual-combustion stroke.

2. Description of the Related Art

In the related art, it has been known to use internal combustion engines to generate mechanical force to cause locomotion or otherwise perform work. Internal combustion engines typically use fossil fuels or other fuels that are of a limited nature. Due to the finite supply of fuel it is important to use such efficiently. Increasing the power to weight ratio of an engine improves efficiency. Reducing friction as well as reducing impulse forces in a combustion cycle increases efficiency. Therefore there is a need for an internal combustion engine configuration which is more efficient, effective, and enhances performance. Some improvements have been made in the field. Examples include but are not limited to the references described below, which references are incorporated by reference herein:

U.S. Pat. No. 5,967,103, issued to Kuperman, discloses a three cycle, two-stroke internal combustion engine from which work can be extracted in two directions. In the preferred embodiment, the inventive two-stroke engine is constructed as a cylinder having a reciprocating piston slidably seated therein, with the piston defining a compression and combustion chamber between the cylinder wall and each side of the piston. The two-stroke engine can provide work in bi-directional fashion from the two combustion chambers acting in phase. A piston rod is provided with reciprocating linear motion, and a mechanical converter is used to change the linear movement to rotational motion providing torque from which rotational power can be extracted for machinery. In an alternative embodiment, the cylinder is shaped with a bottom portion which is split into two sections, in which a bifurcated piston is seated in reciprocating fashion. A piston rod extending through the space between the split cylinder sections is driven with conventional side-to-side linear motion, and is connected to a conventional offset crankshaft, to harness the useful work output of the engine. The two-stroke engine is compact in size and more powerful than a similar 4 or 2-cycle engine, since its dual action makes it equivalent to two combined standard engines. The engine also provides a reduction in overall weight, decreasing the weight-to-power ratio, with an increase in fuel efficiency. Recoil impulses from the torque produced are reduced, increasing the engine life.

U.S. Pat. No. 4,913,100, issued to Eickmann, discloses a double piston engine has a doubly acting piston reciprocably provided in a cylinder arrangement to form two working chambers which periodically increase and decrease their volumes. The invention provides inlet means with supply means for a cleaning flow through the working chambers and inlet means and supply means for a loading flow in excess of atmospheric pressure to the respective chambers. Means are further provided to secure that the loading flow enters the respective working chamber after the closing of the inlet for the cleaning flow. By this arrangement of the invention it becomes possible to operate two cycle engines with turbochargers or other loaders. A very powerful engine at compact space and low weight is obtained, while the poisonous gases of two stroke engines are prevented to a high degree.

U.S. Pat. No. 4,414,927, issued to Simon, discloses a two stroke oscillating piston engine comprising cylinder sections provided with feed chambers for additional fresh air. The two outer rings, acting as pistons, draw in fresh air through intake ports and force that air to enter combustion chambers through communication ducts and ports. The middle ring is intended for the fresh gas supply of the combustion chambers. The radial grooves for fresh air are provided at a shorter distance from the ports than the radial grooves for fresh gas. Burnt and expanded gas is first exhausted from the combustion chambers by fresh gas; then the combustion chambers are filled with fresh gas and fresh air. Thus, exhausting unburnt gas together with burnt gas is avoided and improved combustion is provided in the combustion chambers.

U.S. Pat. No. 5,676,097, issued to Montresor, discloses a double-acting, single-cylinder, explosion engine whose peculiarity is to be provided with auxiliary components which permit to optimize the inlet stroke because such auxiliary components are arranged in a way that the gases to be burnt are not inlet by the piston. Such gases are inlet by the auxiliary components. In general the present engine comprises a cylinder in which a piston may run. The median axis of the piston is interested by a through-shaft which is fixed and coaxial to the piston itself. The shaft is divided in two half-shafts having the same size and shape by the piston. The half-shafts comprise pistons which may run in inlet chambers and narrowings or holes, openings, leaks or the like through which the inlet gas passes to reach the respective explosion chambers through heads. The cylinder is provided with exhausts at its median part. The above described engine is connected with at least a connecting rod and is able to do two active bursts during a turn of 360.degree. of the connecting rod.

U.S. Pat. No. 2,070,769, issued to Wurtele, discloses an internal combustion engine.

U.S. Design Pat. No. 494,191, issued to Aketa et al., discloses the ornamental design for an internal combustion engine.

The inventions heretofore known suffer from a number of disadvantages which include unduly complex, limited efficiency, limited power, and/or otherwise fail to increase power to weight ratio as compared to a standard combustion engine.

What is needed is an internal combustion engine that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available internal combustion engines. Accordingly, the present invention has been developed to provide an internal combustion engines with a cylinder and piston having a dual-combustion stroke.

In one embodiment of the invention, there may be an internal combustion engine. The engine may include one or more of the following: a first piston system including one or more of the following: an engine block; a cylinder through the engine block; a piston disposed within the cylinder, the piston including a cavity therein; a stump member disposed within the cylinder and sized to be received by the cavity; a first combustion chamber within the cylinder defined between the piston and the cylinder; a second combustion chamber within the cylinder defined between the piston, the stump member, and the cylinder when the stump member is disposed within the cavity; an inlet port disposed through the engine block orthogonal to a direction of travel of the piston; an outlet port disposed through the engine block orthogonal to the direction of travel of the piston; a camshaft in mechanical communication with the piston of the first piston system; a second piston system in mechanical communication with the camshaft and substantially identical to the first piston system; and a distributor system, including one or more of the following: a distributor; and a spark plug wire having one or more of the following: a first end coupled to the distributor; a second end in direct electrical communication with the first end and in communication with the first combustion chamber; and a third end in direct electrical communication with the first end and in communication with the second combustion chamber of the second piston system.

In one embodiment, the internal combustion engine may be a V-configuration. The inlet port and the outlet port may have unified plumbing.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
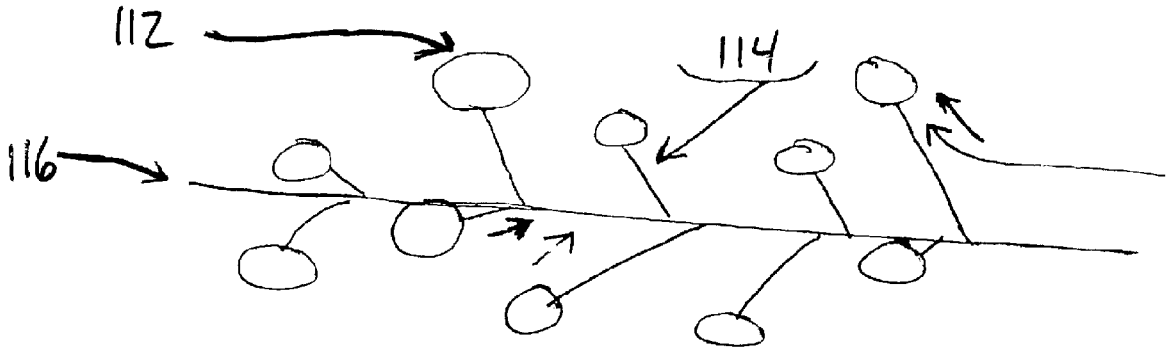
FIG. 1 illustrates a system diagram of a piston assembly according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment,"

or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

The mountain engine, new never before designed. Used for maximum power to climb steep grades up the mountain while carrying the maximum weight load allowed by the law.

In the mountain engine's cylinders, are cylinder stumps. These cylinders stumps act as a piston when the actual piston is in the down or bottom position. While in the down or bottom position, the underside of the piston acts as a cylinder; or the bottom half is actually a cylinder in itself. The cylinder stump is fixed and cannot move. It is cast into the engine cylinder and engine block during the casting process. These cylinder stumps resemble the stumps that are left after the cutting down of a tree.

When the piston is in the down position over the stump; this acts in the same manner as top dead center does when in fact it is at the bottom dead center position. When in this position there is the area of squish and can be full of or filled with ignitable mixture or combustible fuel (could be used as gasoline or diesel engine) and caused to detonate (either by spark or pressure) thus blowing the piston up toward the top dead center position. The blowing up of the piston assists in the blowing down of the piston that would be in the ignition phase of the regular firing order on the power stroke from actual top dead center or where ever ignition is to take place in degrees near or after T.D.C. *NOTE* In one embodiment, it is of extreme importance that the timing of the piston to be blown up is exactly the same exact moment of when the piston to be blown down occurs.

In this engine there will be two cylinders firing simultaneously or at the same time at all times instead of one cylinder firing at a time at all times while running. This applies more force or torque and power to the spinning of the crankshaft and possibly delivering twice the driving force, horsepower and torque. Closely resembling the power of two engines operating together in one engine.

As shown in FIG. 1 there are a plurality of pistons 112 and connecting rods 114 and a crankshaft 116. The pistons 112 being pivotably attached to the connecting rods 114 and the connecting rods 114 being pivotably attached to the crankshaft 116. In operation, one is blown down, another is blown up, at the same time. This is what makes these pistons 112 different from conventional pistons 112 and thus shall be referred to as "blow up pistons 112". Through the middle or center of the cylinder stump 118 is a hole of sufficient diameter as to allow the normal operation of the pistons 112 connecting rod 114 to the crankshaft 116.

Figure 2:
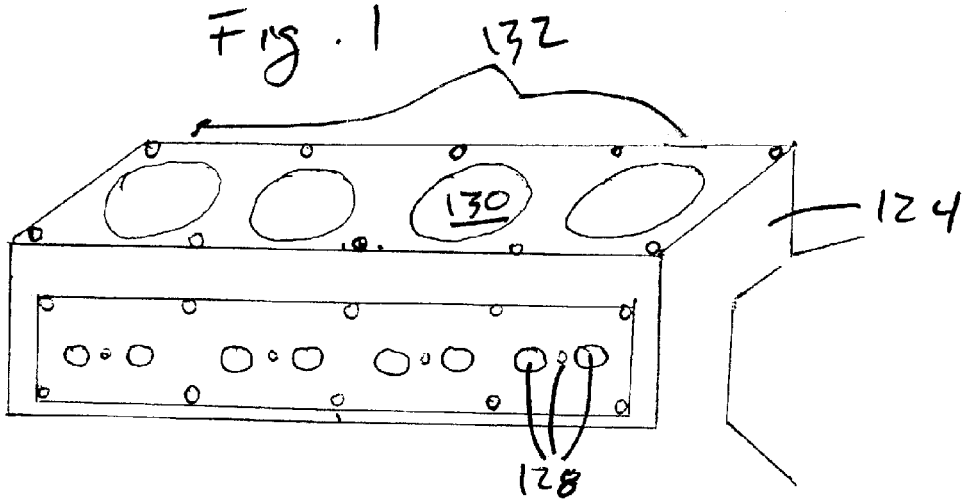
FIG. 2 illustrates a side perspective view of an engine block according to one embodiment of the invention.

There shall be described the means for getting a combustible mixture into the bottom squish area or lower combustion chambers 122 of the present invention. This is achieved by the use of a side head 120. The side head 120 is how the combustible mixture gets into the bottom squish area or the lower combustion chambers 122. As shown in FIG. 2, on the sides of the present inventions engine block 124, there are ports or holes 128 that go all the way through from the outside of the side of the block to the inside of the lower cylinder. Two holes 128 for each cylinder. One for the intake and one for the exhaust.

Figure 3:
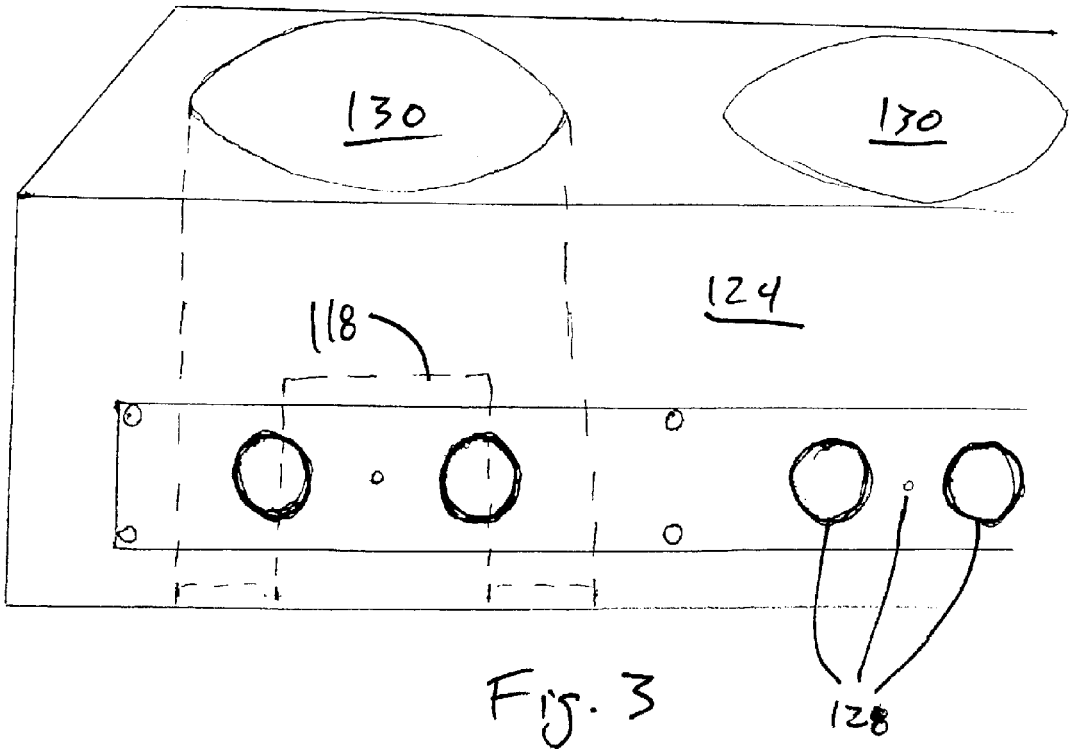
FIG. 3 illustrates a partial side perspective view of an engine block according to one embodiment of the invention.

The top of the engine block 124 is machined for the application of a cylinder head 170. The side of the engine block 124 is also machined like the top of the engine block 124 for the application of a cylinder head 120 type of apparatus or a side rack for the letting in and the letting out of fuel mixture or air and exhaust into and out of the lower combustion chambers 122 of the cylinders. As shown in FIG. 2 there are two holes 128 disposed in the side of the block which are oriented horizontal. As further shown in FIG. 3 there is one hole 128 which allows for fuel to be feed into the cylinder, the other hole 128 allows for the evacuation of spent fuel materials another hole for spark plug 128. As illustrated the stump is disposed at the base of the cylinder.

Figure 4:
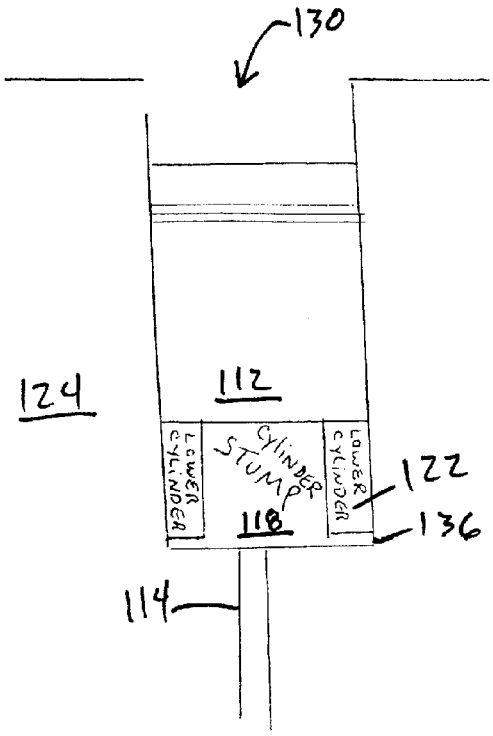
FIG. 4 illustrates a cross-sectional side view of a cylinder according to one embodiment of the invention.

As shown in FIG. 4 there is a side view of the block 124, cylinder 130, piston 112, cylinder stump 118 and connecting rod 114. The connection and orientation of the components relative to the others is shown.

Figure 5:
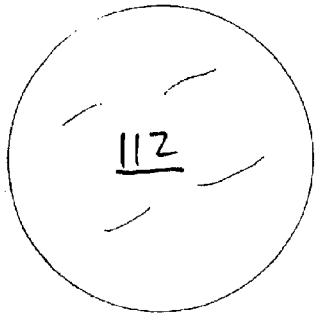
FIG. 5 illustrates a top planar view of a piston according to one embodiment of the invention.
Figure 6:
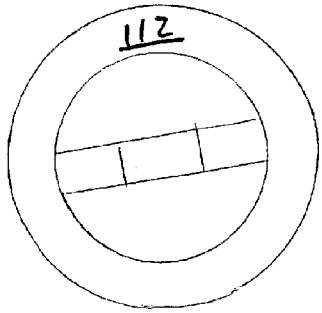
FIG. 6 is a bottom planar view of a piston according to one embodiment of the invention.

As shown in FIG. 5 there is a top view of a piston 112. As illustrated it is flat on the top. As shown in FIG. 6 there is a bottom view of the piston 112. As illustrated the bottom of the piston 112 is shaped so as to have a cylindrical portion interior thereto. There is a portion where a connecting rod 114 connects thereto.

Figure 7:
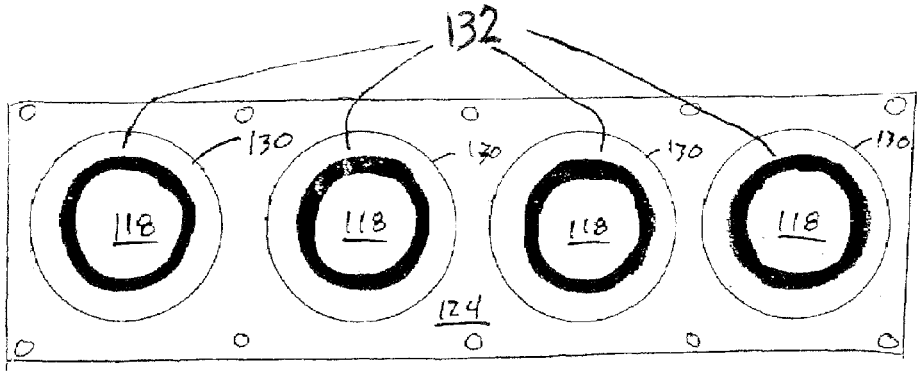
FIG. 7 illustrates a top planar view of a cylinder bank according to one embodiment of the invention.

As shown in FIG. 7 there is a top view of a bank of cylinders 130 disposed in a line being formed into an engine block 124. The top view thereof may represent a four cylinder engine block 124 or one side of an 8 cylinder engine block 124 of the present invention. The heavier or darker rings represent the cylinder stumps 118 at the bottom of the cylinders. The outer light rings are the cylinders.

Figure 8:
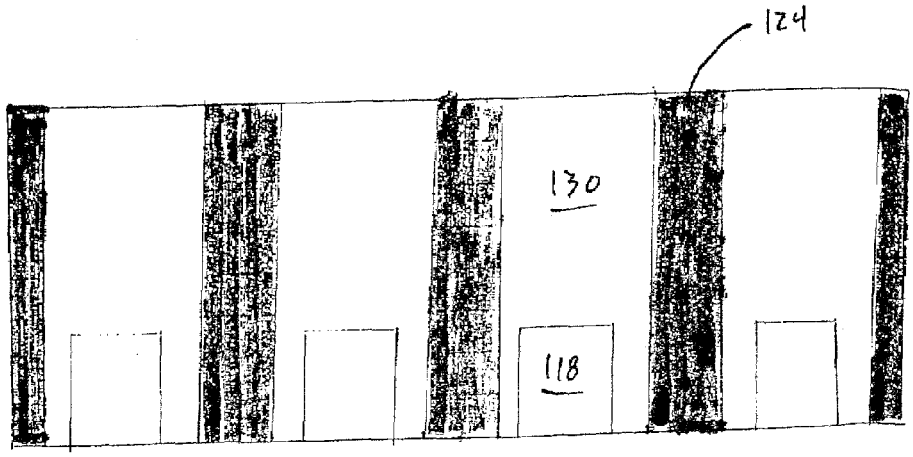
FIG. 8 illustrates a side cross-sectional view of a cylinder bank according to one embodiment of the invention.

As shown in FIG. 8 there is a cross-sectional side view of a 4-cylinder engine or one side of an 8 cylinder engine block 124 according to embodiment of the present invention. There is illustrated a cylinder stump 118 disposed at the base of each of the cylinders.

Figure 9:
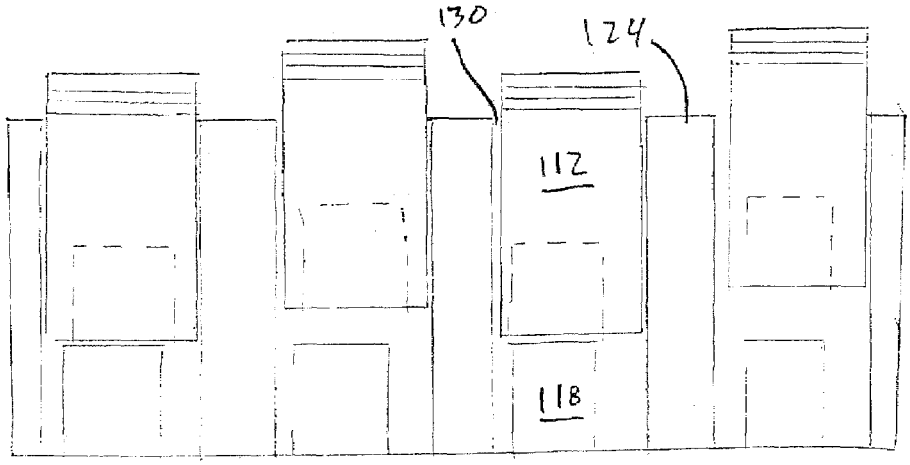
FIG. 9 illustrates a side cross-sectional view of a cylinder bank according to one embodiment of the invention.

As shown in FIG. 9 there is a cross-sectional view of a block with a piston 112 disposed in each cylinder. The phantom lines represent the internal cylindrical shape formed into the bottom of each piston 112. The illustration is indicative of how the piston 112 and the cylinder stump 118 relate to each other and how it is that the piston 112 may be moved to the bottom of its stroke and fit over the cylinder stump 118.

Figure 10:
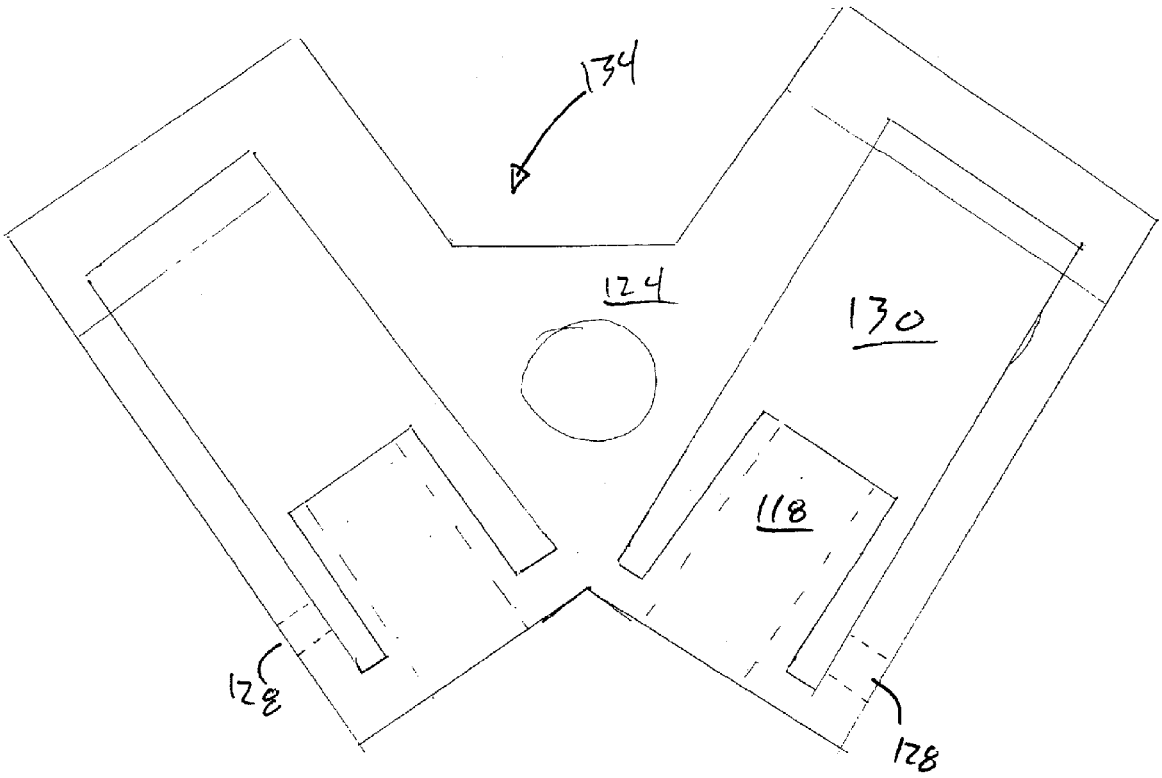
FIG. 10 illustrates a cross-sectional view of a V-block according to one embodiment of the invention.

As illustrated in FIG. 10 there is a cross-sectional view of a V-block 134, according to one embodiment of the invention. There is shown the cylinder shape with stumps 118 cast into the block with phantom lines indicating lower cylinder ports 128 and holes through the center of each stump 118 for the connecting rod 114 to travel to the crankshaft 116.

Nomenclature of the mountain engine: Cylinder 130 (having an outside diameter), Cylinder floor 136 (having a thickness), Cylinder stump 118 (having a height, outside diameter, inside diameter), Upper combustion chamber 140, Lower combustion chamber 122, Upper squish area 140, Lower squish area 142, Lower cylinder ports 128, Blow-up pistons 112 (having an outside diameter, an inside diameter, a skirt thickness, height).

Figure 11:
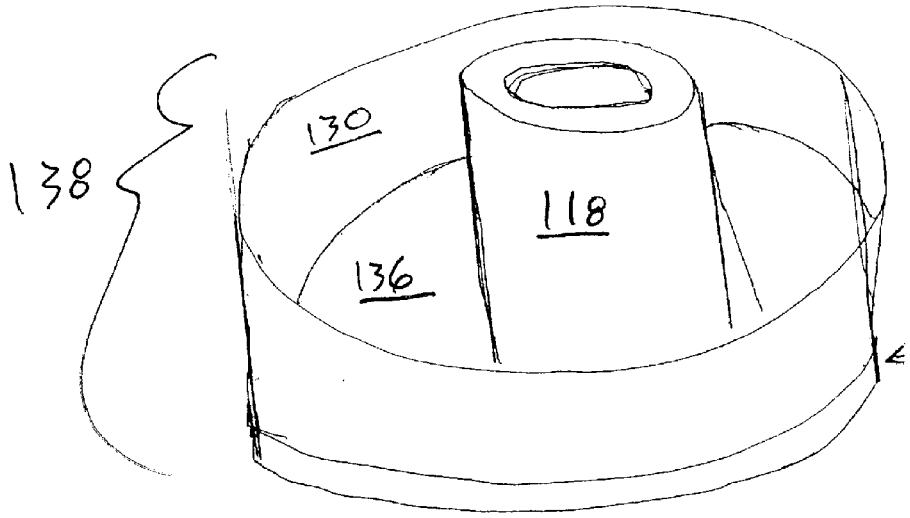
FIG. 11 illustrates a top perspective view of a lower combustion chamber according to one embodiment of the invention.

Shown in FIG. 11 is the lower combustion chamber 138 with the cylinder stump 118 being disposed at the cylinder floor 136 of the cylinder 130. The wall thickness of the cylinder stump 118 should be substantial so as to provide the structural integrity necessary for the stump 118 to aid in the combustion process and withstand the force exerted during the explosions. The inside of the center hole in the stump 118 is of substantial diameter so as to allow the connecting rod 114 to operate through it. The cylinder stump 118 and cylinder floor 136 should be cast into the block 124 as a portion of the cylinder 130. The cylinder floor 136 has a substantial thickness so as to withstand the force exerted thereon during the combustion cycles.

Figure 12:
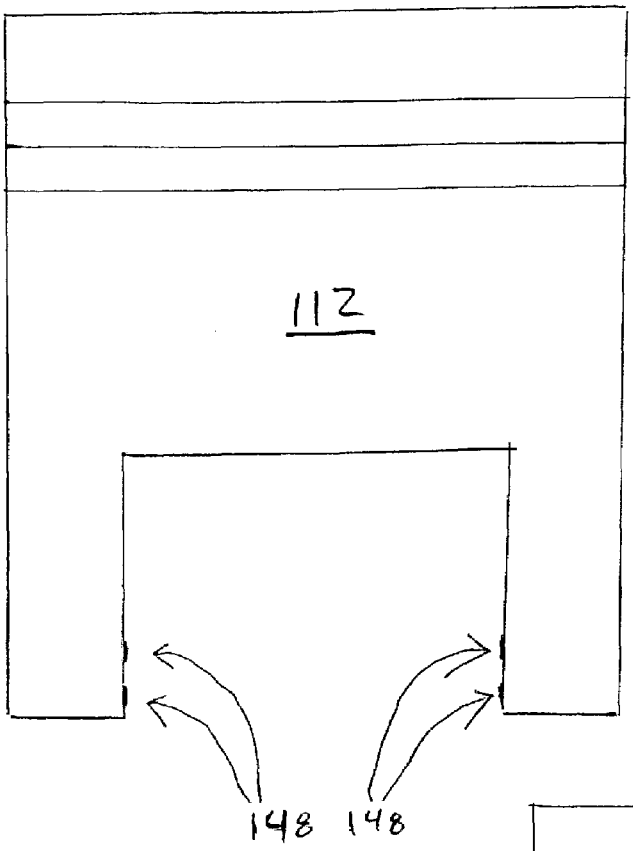
FIG. 12 illustrates a side cross-sectional view of a piston according to one embodiment of the invention.
Figure 13:
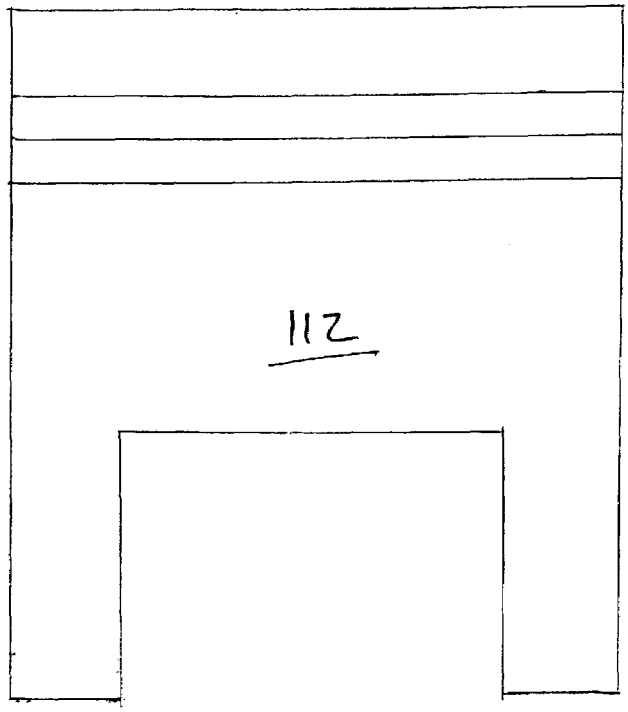
FIG. 13 illustrates a side cross-sectional view of a piston according to one embodiment of the invention.
Figure 14:
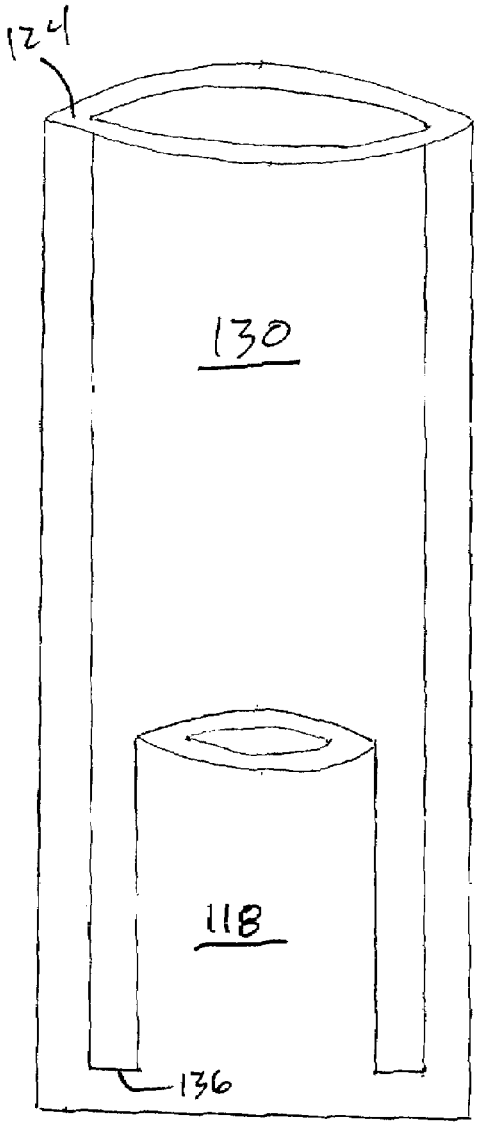
FIG. 14 illustrates a side perspective cross-sectional view of a cylinder according to one embodiment of the invention.
Figure 15:
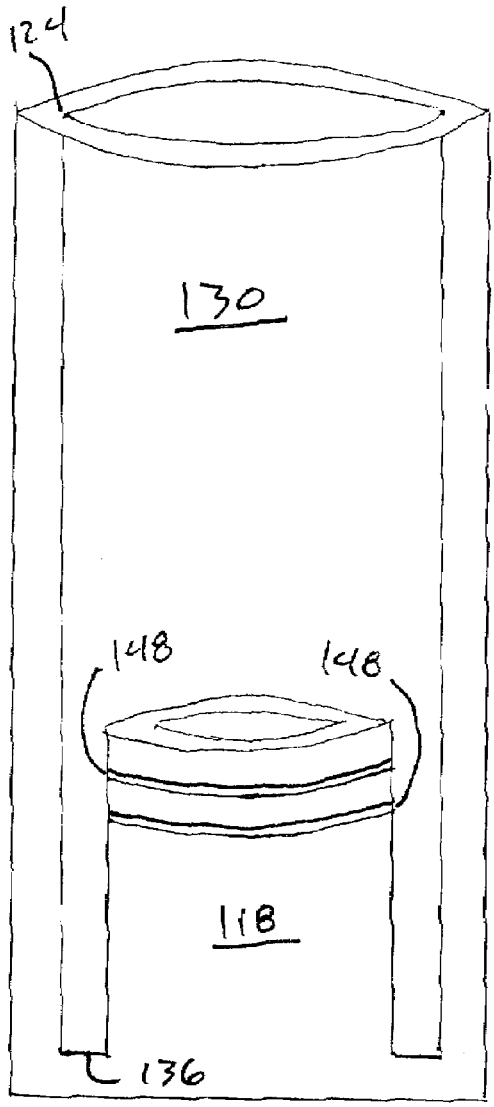
FIG. 15 illustrates a side perspective cross-sectional view of a cylinder according to one embodiment of the invention.

As shown in FIG. 12 there is a cross-sectional view of a piston 112 according to one embodiment of the invention. The piston 112 cylindrically shaped being similar on the top and outside thereof to conventional pistons 112. There are piston rings 148 disposed on the outside surface thereof. The underside portion of the piston 112 has an internal cylindrical shape. In one embodiment there are piston rings 148 disposed upon the interior cylindrical surface of the piston 112. As shown in FIG. 13, in an alternative embodiment there are no piston rings 148 upon the interior cylindrical surface of the piston 112. Alternatively the piston rings 148 may be applied upon the outside cylindrical surface of the cylinder stump 118. FIG. 14 shows, according to one embodiment, a cylinder stump 118 having no piston rings 148 disposed thereon. FIG. 15 shows, according to an alternative embodiment, a cylinder stump 18 having piston rings 148 disposed thereon set into grooves formed into the surface of the cylinder stump 118.

Figure 16:
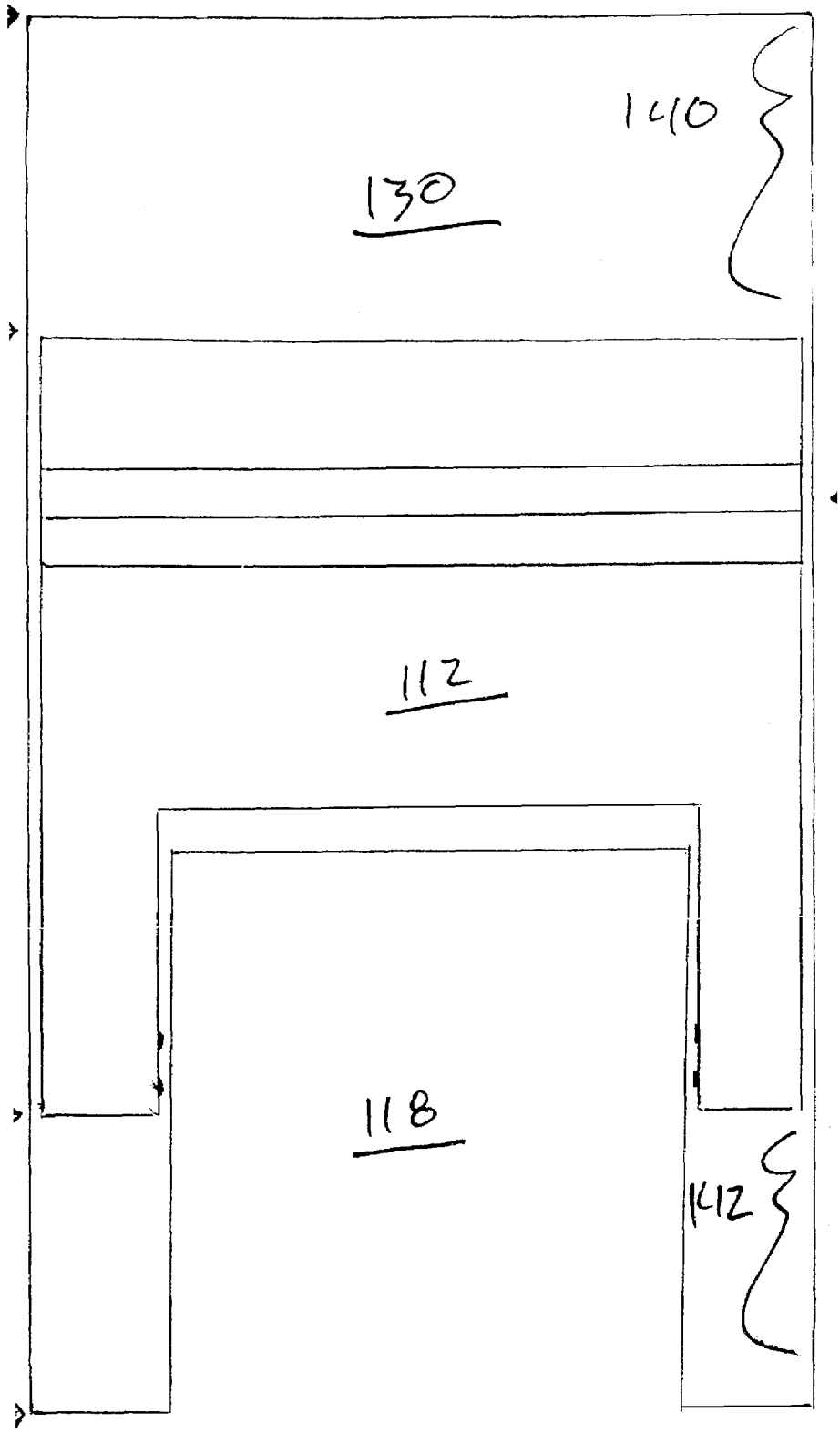
FIG. 16 illustrates a cross-sectional side view of a cylinder and piston according to one embodiment of the invention.

Piston travel in cylinder 130 is centralized due to, and in order to have squish area on both ends of the cylinder; upper squish area 140 and lower squish area 142. Producing upper and lower cylinder 130 space in one cylinder 130 or two combustion chambers in one cylinder. Squish areas, 140 and 142, in FIG. 16 are exaggerated in size to provide a clear example of the two combustion portions. FIG. 16 shows the bottom of a cylinder 130 and cut away view of lower end of piston 112 to show stump up inside it.

Figure 17:
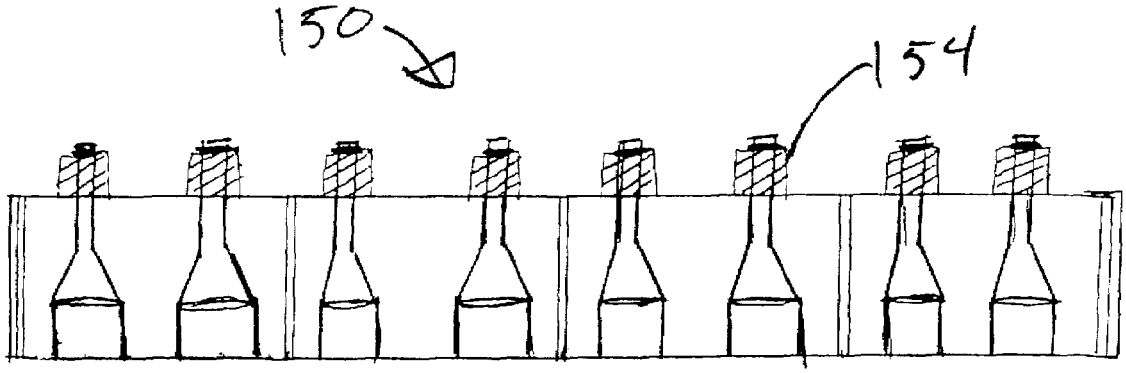
FIG. 17 illustrates a cross-sectional side view of a side rack or side head valves according to one embodiment of the invention.
Figure 18:
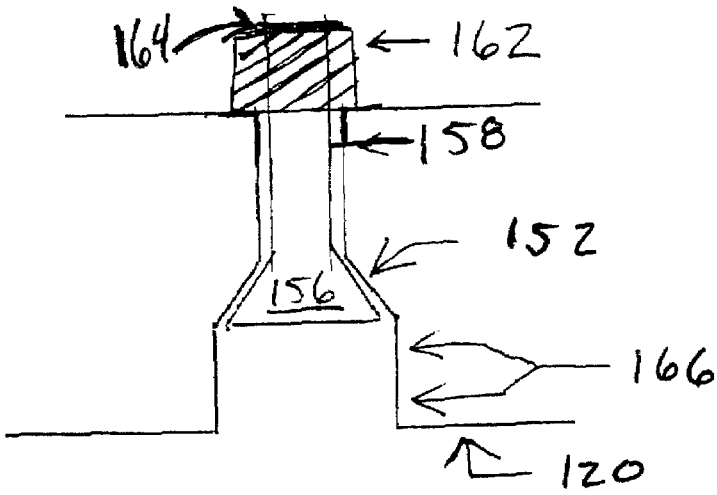
FIG. 18 illustrates a cross-sectional side view of a valve according to one embodiment of the invention.

FIG. 17 shows a cross-sectional view of a side rack or side head valves 150. The valves 150 are similar to conventional type of valve heads with the exception of the valve seat 152 being recessed further back into the head. FIG. 18 shows a partial cross-sectional view of a valve head 150. There is illustrated in FIG. 18 a valve 156, disposed within a valve stem guide placement area 158 and in one position having the valve 156 abutting a valve seat 152. There is also a valve spring 162, biasing the valve 156 in a position where the valve 156 abuts the valve seat 152. The valve spring 162 is fixably attached to the valve 156 and the side head 150 by a retainer lock 164 which is fixably attached to the end of the valve 156 distal from the valve 156. The length of the valve 156 and the allowable travel of the valve 166 are such that the valve does not extend beyond the valve travel area 166. The inside diameter of the valve travel area 166 must be larger than the valve face 168 diameter to prevent touching or scraping of valve face 168 diameter with the sides of the valve travel area 166 and to allow air flow in and out of lower cylinders. Valve travel must not exceed the distance of the valve travel area 166 to prevent the valves 156 from hitting into the side of the engine block 124 or either the side of the piston 112 when the valves 156 are opened while bolted to the block and in operation.

Figure 19:
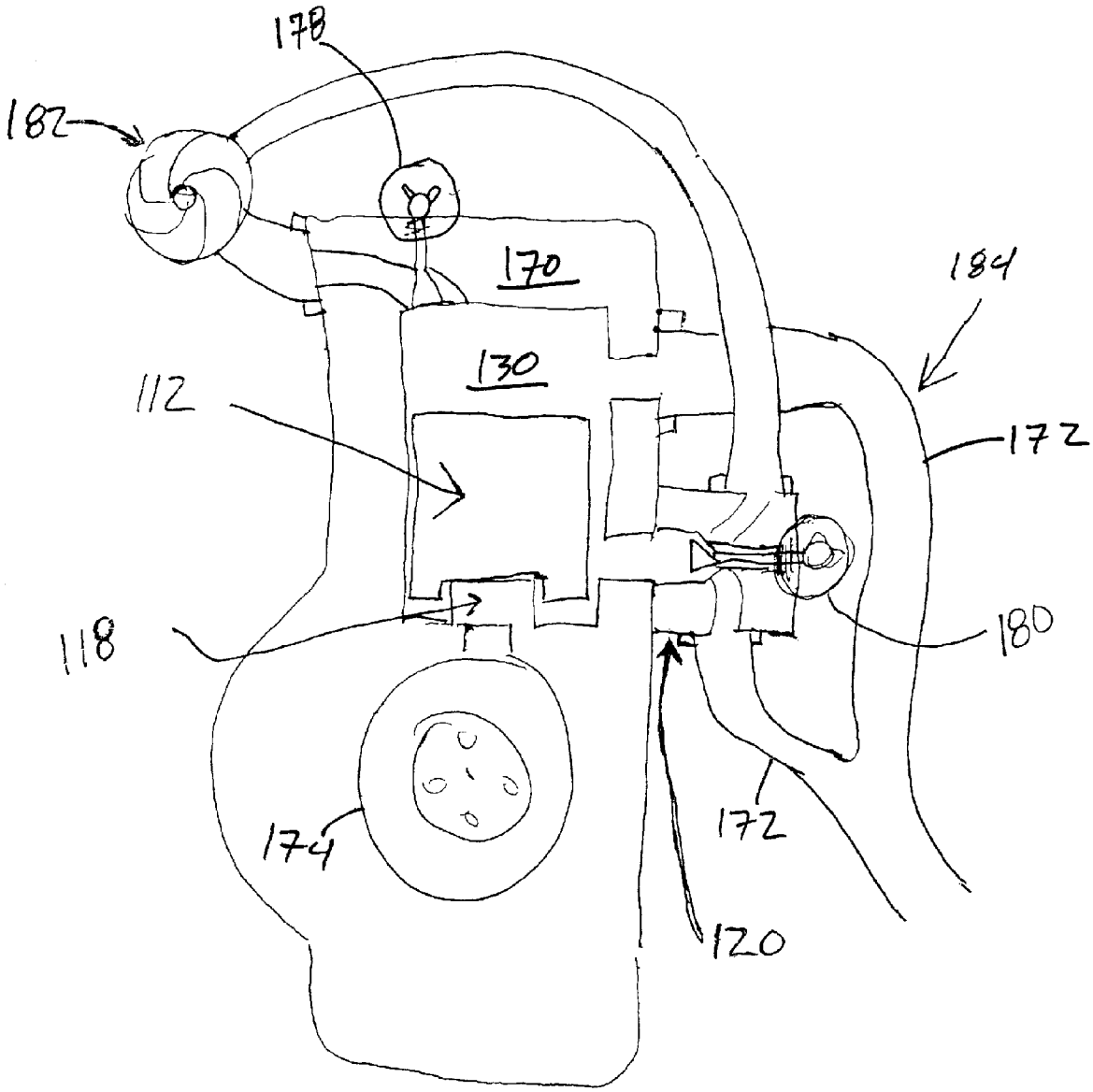
FIG. 19 illustrates a cross-sectional view of an engine according to one embodiment of the invention.

FIG. 19 illustrates a cross-sectional view of an engine where the present invention is incorporated. The figure shows a piston 112, cylinder stump 118, and cylinder 130 in the block of an engine. A top head 170 is shown disposed on the engine block 124 at the top of the cylinder. The side head 120 is shown disposed on the engine block 124 to the side of the cylinder. There are exhaust pipes 172 shown fixably attached to the top head 170 and the side head 120. Proper timing is necessary so that the top and side valves operate at the correct times with respect to each other and the position of the piston 112 in the cylinder. Proper timing may be achieved by either a timing belt or a timing chain or by gears. The top head 170 valves operate via an overhead camshaft 178 OHC. There is also a camshaft 180 to operate the side head valves 150.

Figure 20:
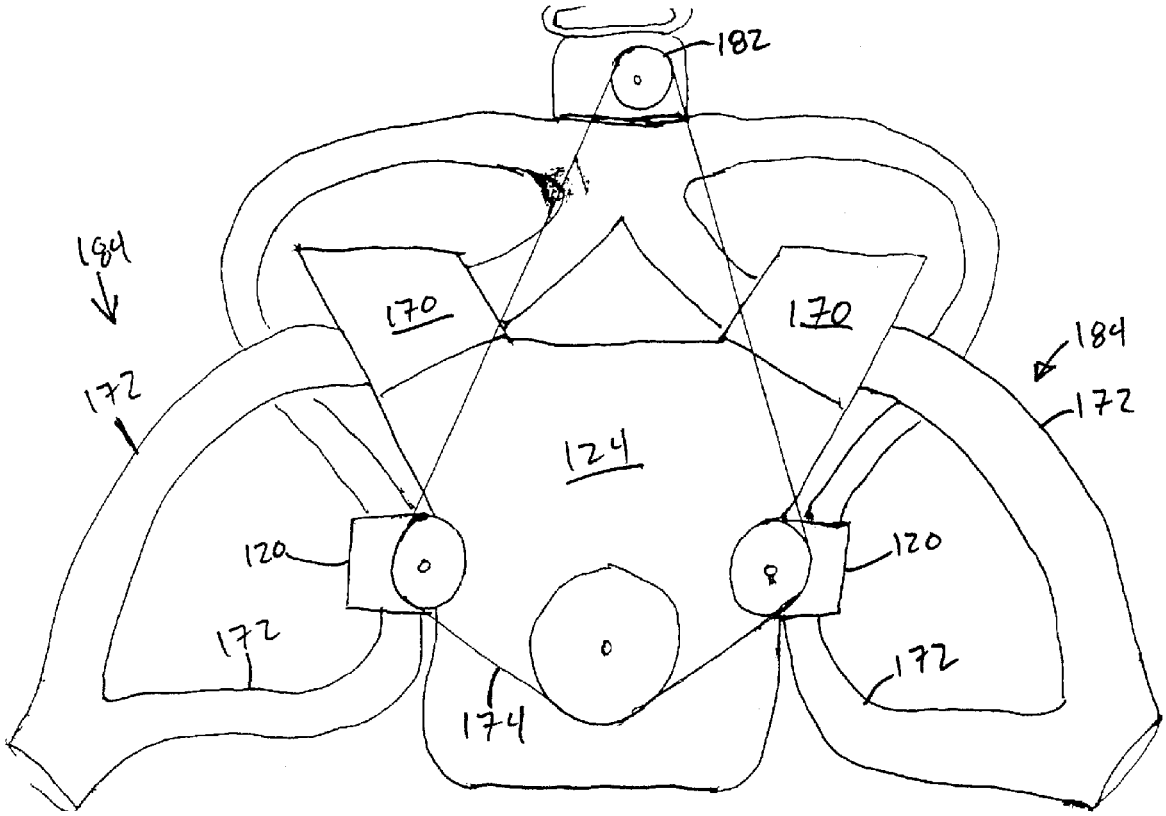
FIG. 20 illustrates an elevational side view of an engine according to one embodiment of the invention.

FIG. 20 illustrates a front view of the present invention, according to one embodiment. The figure illustrates the intake and exhaust systems, 182 and 184 respectively, and how they are connected to the engine heads 120 and 170. The intake has unified plumbing and the exhaust has unified plumbing. The same intake system 182 feeds fuel into the upper and lower combustion chambers 140 and 142 via the respective heads, 120 or 170. The same exhaust system 184 that evacuates the exhaust gases from the upper combustion chamber 140 also evacuates exhaust gases from the lower combustion chamber 142 via the respective heads 120 and 170. Pulleys on the heads turn the camshafts. Upper heads are operated by a conventional camshaft located in the engine block.

Figure 21:
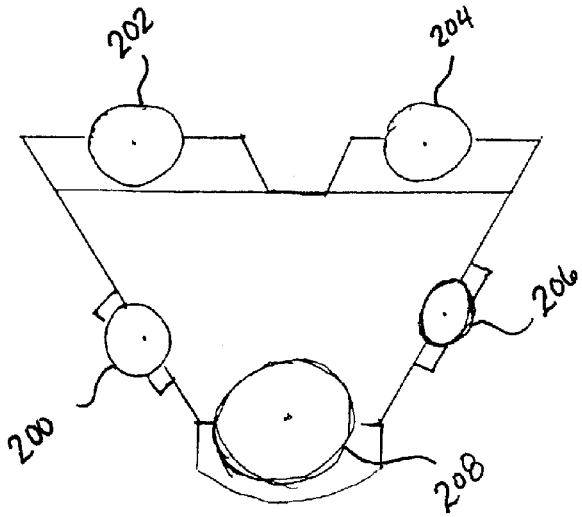
FIG. 21 illustrates an elevational side view of a V-configuration engine according to one embodiment of the invention.
Figure 22:
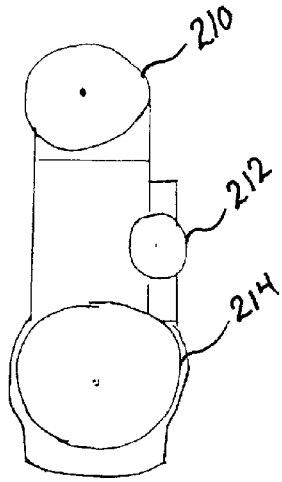
FIG. 22 illustrates an elevational side view of an L-configuration engine according to one embodiment of the invention.

It is envisioned that the present invention operates like any other; both gasoline engines and diesel engines. For gasoline, a threaded hole in the side rack or side head for the use of a spark plug would be made. For diesel, a hole in the side rack or side head for the use of a fuel injector would be made. As shown in FIG. 21 and 22 different types of engines may be designed involving the present invention.

FIG. 21 shows V-type engines; V-6, V-8 V-10, and/or V-12. FIG. 22 shows L-type engines; L-4 and/or L-6. In fact this engine design is for both gasoline engines and diesel engines of all types and kinds. Also for both 2 stroke engines and 4 stoke engines. For gasoline engines a threaded hole in the side rack or side head 120 for the use of a spark plug would be made. For diesel a hole in the side head 120 for the use of a fuel injector would be made. There are shown pulleys or gears 200, 202, 204, 206, 210, and 212. Further shown are the crankshaft pulleys 208 and 214.

Figure 23:
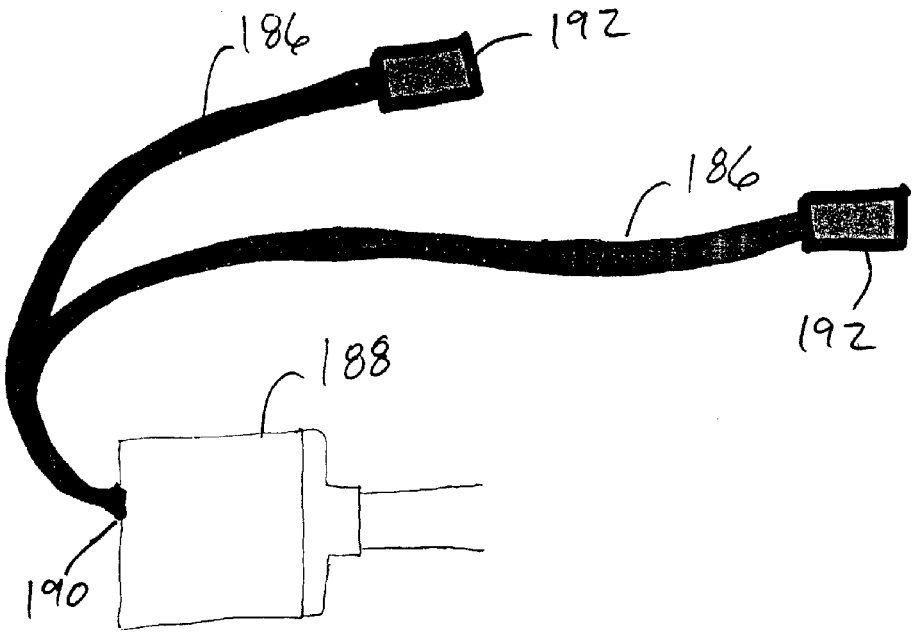
FIG. 23 illustrates a partial view of a distributor and spark plug wire according to one embodiment of the invention.

To distribute a spark into the side head 120 as well as the top head 170 there is a spark plug wire 186 that split into two wires for a gasoline type engine. In FIG. 23 there is shown a distributor 188 with a spark plug wire 186 which splits into two extending therefrom. There is a spark plug wire 186 like none other and never seen before. This spark plug wire 186 is plugged in the distributor cap 190 in the same method as any other spark plug wire 186. However the difference is in the spark plug wire 186 being split into two spark plug wires 186 from and still connected together by one. At the ends of the two spark plug wires 186 that were split are spark plug boots 192. These go over and connect to two different spark plugs. The two different spark plugs would be one for the upper combustion chamber 140 of one cylinder 130 and the other for the lower combustion chamber 142 of the corresponding cylinder 130. The corresponding cylinder 130 is hereby defined as the cylinder 130 whose opposite end combustion chamber is to be ignited for a power stroke at the exact same moment as itself. For instance when one piston 112 is to be blown up or down; it would be which ever other piston 112 is to be blown down or up at that exact same moment. This spark plug wire 186 could ensure that simultaneously igniting two cylinders at the exact same moment in time would be accomplished or done. One into two split spark plug wire 186. If the present invention is to be diesel, then the same effect is achieved by the timing of the different camshafts to operate in unison for timing of the fuel injectors of the two corresponding cylinders.

Looking to FIG. 22, there is shown an L-configuration engine including pulleys or gears 210 and 212 to turn two camshafts located therein, including the crankshaft pulley 214.

Figure 24:
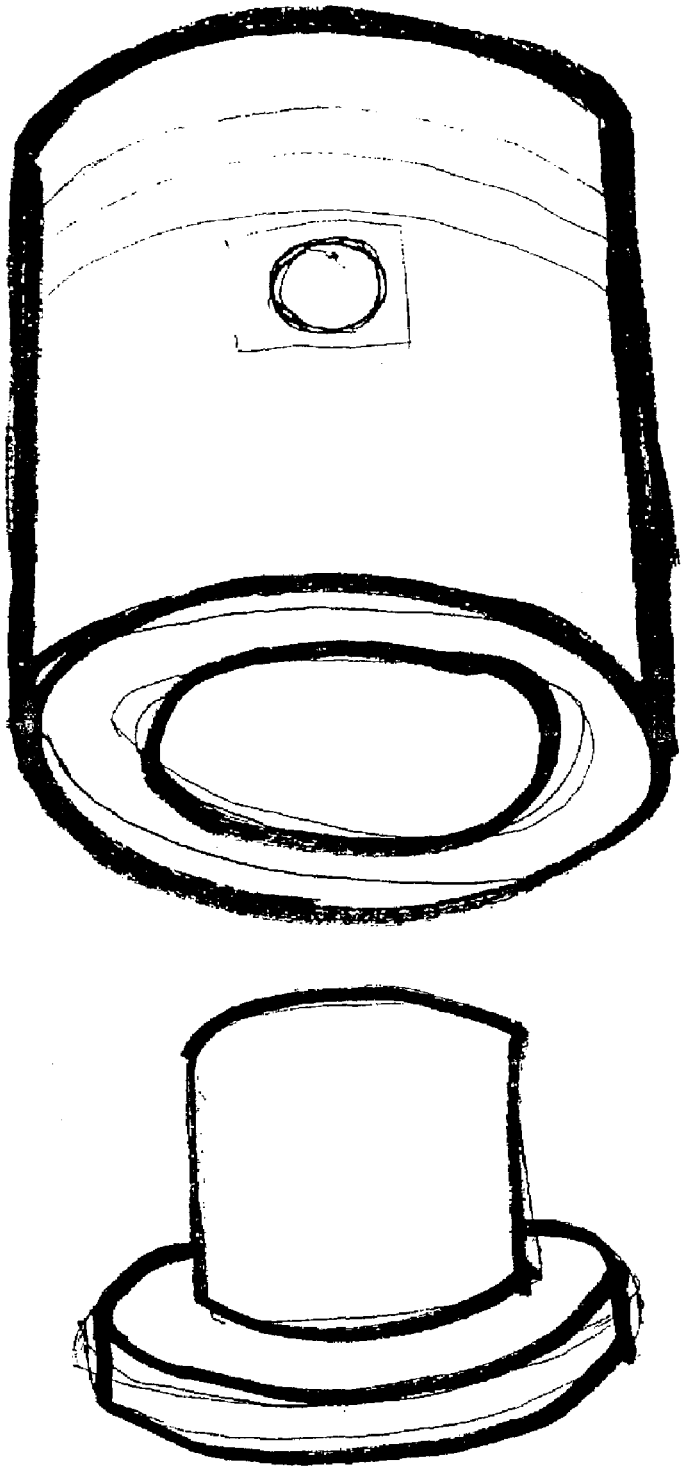
FIG. 24 illustrates a perspective side view of a stump and piston according to one embodiment of the invention.

As illustrated in FIG. 24 there is a blow up piston 112 as an actual appearance (bottom is cylinder shaped). There is also shown the cylinder stump 118 which mates like a piston.

In building, a user may insert a connecting rod from the bottom through the cylinder stump. A user may insert piston from the top down into the cylinder. A user may keep the piston's connecting rod attachment hole above the deck of the engine block. A user may insert connecting rode into the piston. A user may insert the connecting rod pin or bushing through hole in piston thereby securing the rod to the piston. A user may insert the two rod pin retainer clips, one on each side of the piston where the rod pin is kept through the piston. A user may lower the piston further down into the cylinder. Then connect the connecting rods to the crankshaft properly. During proper operation of piston, the extreme lower end of the piston never goes higher than the top of engine stump to prevent raw fuel and spent gases from entering into the crankcase and to ensure a cylinder/piston relationship between the engine stump (now piston) and the lower end of piston (now cylinder). Thus effectively creating a lower combustion chamber in the lower end of each cylinder.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. An internal combustion engine, comprising:

a first piston system including:

an engine block;

a cylinder through the engine block;

a piston with piston rings, disposed within the cylinder, the piston including a cavity therein the underside;

a stump member, disposed within the cylinder and sized to be received by the cavity therein the underside of the piston, and having a bore through the center to a direction of travel of the piston;

a connecting rod, with a first end in direct communication with piston, and a second end in direct communication with the crankshaft;

a first combustion chamber within the cylinder defined between the piston, the cylinder, and an upper engine head;

a second combustion chamber within the cylinder defined between the piston, the cylinder, the stump member, and a cylinder floor;

an inlet port disposed through the engine block orthogonal to a direction of travel of the piston;

an outlet port disposed through the engine block orthogonal to the direction of travel of the piston;

a sparkplug/fuel injector port disposed through the engine block orthogonal to the direction of travel of the piston;

a plurality of multiple heads including:

a plurality of inlet ports and outlet ports;

a plurality of valves, valve springs, valve stem guides, and retainer locks;

an engine head attached to the top of engine block with valves in the direction of piston travel, and in direct communication with first combustion chamber system;

an engine side rack/side head, attached to side of an engine block; having recessed valve seats, recessed valves, and in direct communication with second combustion chamber system;

an engine side rack/side head, having inlet valve ports and outlet valve ports, in direct communication with inlet ports and outlet ports disposed through the engine block orthogonal to the direction of travel of the piston; and an engine side rack/side head, with an spark plug/fuel injector orifice port, in direct communication with spark plug/fuel injector orifice port disposed through the engine block orthogonal to the direction of travel of the piston.

2. The internal combustion engine of claim 1, further comprising:

a first camshaft in mechanical communication with the valves of the first combustion chamber system;

a second camshaft in mechanical communication with the valves of the second combustion chamber system;

the first piston system in communication with the valves of the first combustion chamber system;

a second piston system in communication with the valves of the second combustion chamber system and substantially identical to the first piston system; and a distributor system, including:

a distributor; and a spark plug wire, having:

a first end coupled to the distributor;

a second end in direct electrical communication with the first end and in communication with the first combustion chamber system; and a third end in direct electrical communication with the first end and in communication with the second combustion chamber system.

3. The internal combustion engine of claim 1, comprising of multiple configurations wherein: the engine block is of a V-configuration or the engine block is of an L-configuration.

4. The internal combustion engine of claim 1, wherein having: a plurality of dual unified plumbing systems, comprising:

a first unified plumbing system, having:

an intake plumbing system in direct communication with the first combustion chamber system inlet port and the second combustion chamber system inlet port; and a second unified plumbing system, having:

an exhaust plumbing system in direct communication with the first combustion chamber system outlet port and the second combustion chamber system outlet port.

5. An internal combustion engine, consisting essentially of:

a first piston system including:

an engine block;

a cylinder through the engine block;

a piston with piston rings, disposed within the cylinder, the piston including a cavity therein the underside;

a stump member, disposed within the cylinder and sized to be received by the cavity therein the underside of the piston, and having a bore through the center to a direction of travel of the piston;

a connecting rod, with a first end in direct communication with piston, and a second end in direct communication with the crankshaft;

a first combustion chamber within the cylinder defined between the piston, the cylinder, and an upper engine head;

a second combustion chamber within the cylinder defined between the piston, the cylinder, the stump member, and a cylinder floor;

an inlet port disposed through the engine block orthogonal to a direction of travel of the piston;

an outlet port disposed through the engine block orthogonal to the direction of travel of the piston;

a sparkplug/fuel injector port disposed through the engine block orthogonal to the direction of travel of the piston; and a plurality of multiple heads including:

a plurality of inlet ports and outlet ports;

a plurality of valves, valve springs, valve stem guides, and retainer locks;

an engine head attached to the top of engine block with valves in the direction of piston travel, and in direct communication with first combustion chamber system;

an engine side rack/side head, attached to side of an engine block; having recessed valve seats, recessed valves, and in direct communication with second combustion chamber system;

an engine side rack/side head, having inlet valve ports and outlet valve ports, in direct communication with inlet ports and outlet ports disposed through the engine block orthogonal to the direction of travel of the piston;

an engine side rack/side head, with an spark plug/fuel injector orifice port, in direct communication with spark plug/fuel injector orifice port disposed through the engine block orthogonal to the direction of travel of the piston;

a first camshaft in mechanical communication with the valves of the first combustion chamber system;

a second camshaft in mechanical communication with the valves of the second combustion chamber system;

a first piston system in communication with the valves of the first combustion chamber system;

a second piston system in communication with the valves of the second combustion chamber system, and substantially identical to the first piston system; and a distributor system, including:

a distributor; and a spark plug wire, having:

a first end coupled to the distributor;

a second end in direct electrical communication with the first end and in communication with the first combustion chamber system; and a third end in direct electrical communication with the first end and in communication with the second combustion chamber system.

6. The internal combustion engine of claim 5, comprising of multiple configurations wherein: the engine block is of a V-configuration or the engine block is of an L-configuration.

7. The internal combustion engine of claim 6, wherein having: a plurality of dual unified plumbing systems, comprising:

a first unified plumbing system, having:

an intake plumbing system in direct communication with the first combustion chamber system inlet port and the second combustion chamber system inlet port; and a second unified plumbing system, having:

an exhaust plumbing system in direct communication with the first combustion chamber system outlet port and the second combustion chamber system outlet port.

8. An internal combustion engine, comprising: a first piston system including: an engine block;

a cylinder through the engine block;

a piston disposed within the cylinder, the piston including a cavity therein;

a stump member disposed within the cylinder and sized to be received by the cavity;

a first combustion chamber within the cylinder defined between the piston and the cylinder;

a second combustion chamber within the cylinder defined between the piston, the stump member, and the cylinder when the stump member is disposed within the cavity;

an inlet port disposed through the engine block orthogonal to a direction of travel of the piston; and an outlet port disposed through the engine block orthogonal to the direction of travel of the piston;

a plurality of multiple heads including:

a plurality of inlet ports and outlet ports;

plurality of valves, valve springs, valve stem guides, and retainer locks; an engine head attached to the top of engine block with valves in the direction of piston travel, and in direct communication with first combustion chamber system;

an engine side rack/side head, attached to side of an engine block; having recessed valve seats, recessed valves, and in direct communication with second combustion chamber system;

an engine side rack/side head, having inlet valve ports and outlet valve ports, in direct communication with inlet ports and outlet ports disposed through the engine block orthogonal to the direction of travel of the piston; and an engine side rack/side head, with an spark plug/fuel injector orifice port, in direct communication with spark plug/fuel injector orifice port disposed through the engine block orthogonal to the direction of travel of the piston.

* * * * *